US005697518A

United States Patent [19]

Callahan, Jr.

[11] Patent Number: 5,697,518

[45] Date of Patent: Dec. 16, 1997

[54] HEADER PADDED STATIONERY EQUIPPED WITH ADHESIVE SHEET PADS RECESSED WITHIN THE HEADER

[75] Inventor: Joseph P. Callahan, Jr., St. Paul, Minn.

[73] Assignee: Minnesota Mining and Manufacturing Company, St. Paul, Minn.

[21] Appl. No.: 665,604

[22] Filed: Jun. 18, 1996

[51] Int. Cl.[6] ..... B65H 1/00

[52] U.S. Cl. ..... 221/34; 221/45; 221/63; 221/199; 281/15.1; 281/44

[58] Field of Search ..... 221/33, 34, 45, 221/46, 61, 63, 199; 281/44, 15.1, 23

[56] References Cited

U.S. PATENT DOCUMENTS

| | | | |
|---|---|---|---|
| 1,347,225 | 7/1920 | Kristofek | 281/44 |
| 3,459,329 | 8/1969 | Mochizuki et al. | 221/34 |
| 4,416,392 | 11/1983 | Smith | 221/45 |
| 4,586,629 | 5/1986 | Loder | 221/46 |
| 4,586,631 | 5/1986 | Loder | 221/58 |
| 4,653,666 | 3/1987 | Mertens | 221/45 |
| 4,674,634 | 6/1987 | Wilson | 206/554 |
| 4,742,913 | 5/1988 | Emmel et al. | 206/460 |
| 4,768,810 | 9/1988 | Mertens | 282/12 A |
| 4,770,320 | 9/1988 | Miles et al. | 221/33 |
| 4,781,306 | 11/1988 | Smith | 221/33 |
| 4,907,825 | 3/1990 | Miles et al. | 281/51 |
| 4,986,440 | 1/1991 | Windorski | 221/45 |
| 4,993,590 | 2/1991 | Windorski | 221/46 |
| 5,050,909 | 9/1991 | Mertens et al. | 283/81 |
| 5,080,255 | 1/1992 | Windorski | 221/45 |
| 5,086,946 | 2/1992 | Blackwell et al. | 221/45 |
| 5,135,259 | 8/1992 | Garza | 281/15.1 |
| 5,158,205 | 10/1992 | Bodziak et al. | 221/51 |
| 5,167,346 | 12/1992 | Bodziak | 221/63 |
| 5,397,117 | 3/1995 | Mertens | 221/34 |
| 5,401,547 | 3/1995 | Blackwell et al. | 428/40 |
| 5,518,144 | 5/1996 | Samuelson et al. | 221/33 |
| 5,543,190 | 8/1996 | Johnson et al. | 281/44 |

FOREIGN PATENT DOCUMENTS

| | | | |
|---|---|---|---|
| 1213884 | 11/1960 | France | 281/15.1 |

*Primary Examiner*—H. Grant Skaggs
*Attorney, Agent, or Firm*—Gary L. Griswold; Walter N. Kirn; Michaele A. Hakamaki

[57] ABSTRACT

Header padded stationery having an adhesive tape strip pad, adhesive tape flag pad and/or adhesive note pad recessively mounted to the header of the stationery pad.

16 Claims, 8 Drawing Sheets

Fig.19
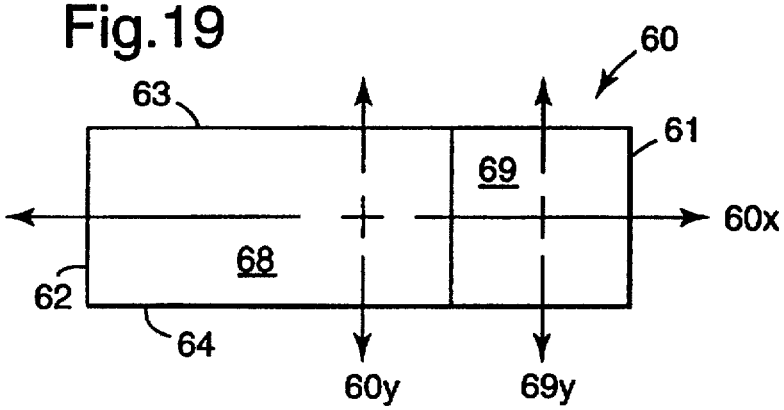
Fig.20
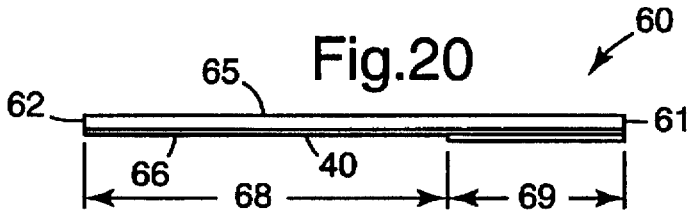
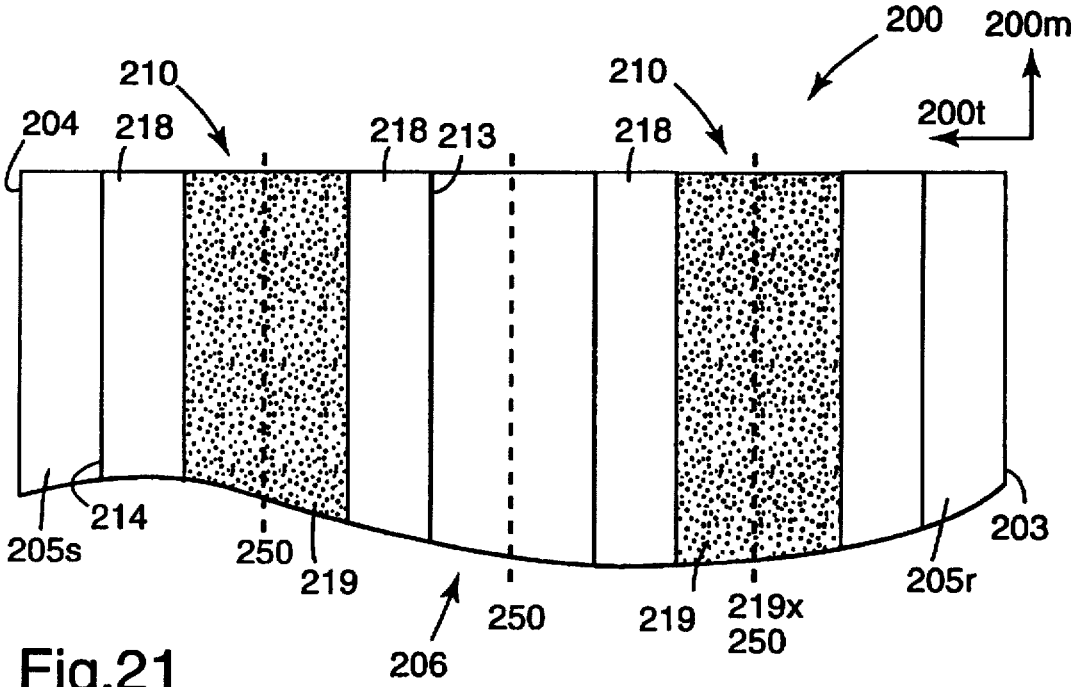
Fig.21

HEADER PADDED STATIONERY EQUIPPED WITH ADHESIVE SHEET PADS RECESSED WITHIN THE HEADER

FIELD OF THE INVENTION

The invention broadly relates to the use of adhesive tape strips, adhesive tape flags and adhesive notes with header padded stationery. More specifically, the invention relates to means for providing a supply of adhesive tape strips, adhesive tape flags and adhesive notes with header padded stationery.

BACKGROUND

Pads of adhesive tape flags and adhesive notes are widely used throughout the world. The most widely used variety of adhesive tape flags and notes are those which utilize a repositionable adhesive. Pads of repositionable tape flags and notes, such as the widely used "Post-It®" brand line of adhesive tape flags and notes sold by Minnesota Mining and Manufacturing of Saint Paul, Minn., have become a staple office supply product throughout the world.

Similarly, rolls of adhesive tape, including rolls of repositionable tape, such as rolls of "Post-It®" brand repositionable tape sold by Minnesota Mining and Manufacturing of Saint Paul, Minn., have long been a worldwide staple office supply product.

Pads of repositionable tape flags have a variety of uses, including the tabbing of pages in a reference book, the flagging of selected documents in a folder, and the designation of selected pages or section of text to be copied.

Pads of repositionable notes have uses similar to those referenced in connection with the tape flags, with the added option of providing written instructions, annotations or other messages on the note.

Rolls of adhesive tape also have a variety of uses, including the wrapping of packages, the sealing of envelopes and boxes, the mounting of signage sheets to a window (e.g. "Dog Lost Poster"), and the mounting easel pad pages to a wall after they have been removed from the easel pad.

A variety of dispensers have been developed for the mils of adhesive tape and the pads of adhesive tape flags and adhesive notes. The dispensers for the pads of adhesive tape flags and adhesive notes include (i) disposable and refillable dispensers, (ii) shuttling and nonshuttling dispensers, (iii) high volume/high profile and low volume/low profile dispensers, (iv) single pad and multiple pad dispensers, and (v) hand held and mountable dispensers.

While the various dispensers available for pads of adhesive tape flags and adhesive notes provide certain benefits for certain applications, a need continues to exist for a dispenser which ensures the availability of adhesive tape flags and notes when needed without requiring the purchase and continuous transportation of a separate dispenser for such pads.

SUMMARY OF THE INVENTION

The invention provides ready access to a supply of adhesive tape strips, adhesive tape flags and/or adhesive notes (hereinafter collectively referenced as "adhesive sheets") by recessively mounting an adhesive sheet pad into the header of a pad of header padded stationery.

The adhesive sheet pad and dispenser are recessed into the header of the header padded stationery such that they do not significantly impact the front-to-back stackable profile of the header padded stationery.

Optionally, the adhesive sheet pad can be retained within a dispensing enclosure and/or a cover provided over the adhesive sheet pad for preventing dispensing of adhesive sheets until the cover is removed.

BRIEF DESCRIPTION OF THE DRAWINGS

FIG. 19 is a top view of the leader strip shown in FIG. 4.

FIG. 20 is an enlarged side view of the leader strip shown in FIG. 19.

FIG. 21 is a top view of a first embodiment of a master pad of adhesive sheets to which two lengths of tabbing material have been laminated.

DETAILED DESCRIPTION OF THE INVENTION INCLUDING A BEST MODE

Nomenclature

Figure 1:
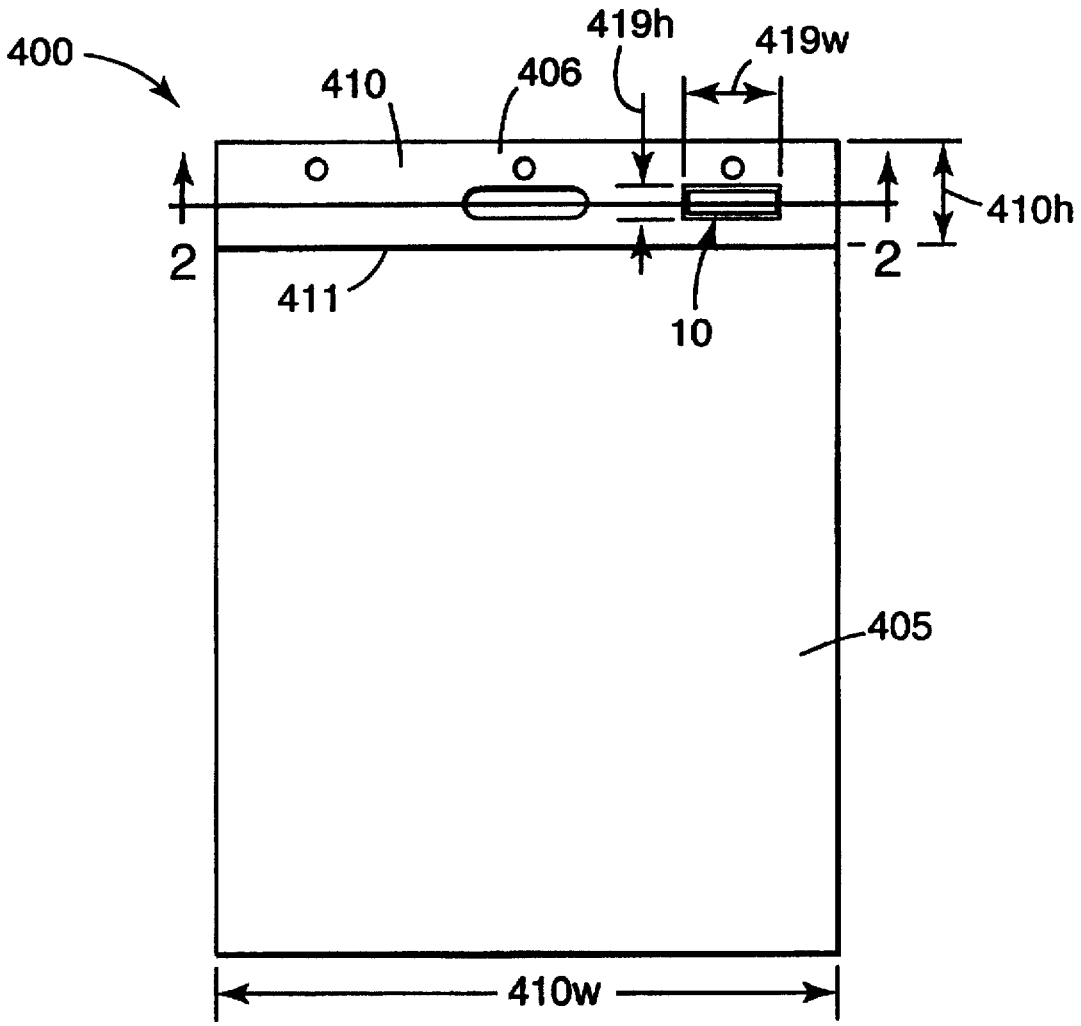
FIG. 1 is a top view of one embodiment of the invention depicting an adhesive tape strip dispenser package recessed within the header of an easel pad.

10 Dispenser Package
20 Adhesive Tape Strip Pad
20*x* Longitudinal Axis of Adhesive Tape Strip Pad
20*y* Lateral Axis of Adhesive Tape Strip Pad
21 First Longitudinal Edge of Adhesive Tape Strip Pad
22 Second Longitudinal Edge of Adhesive Tape Strip Pad
30 Individual Adhesive Tape Strips
30*s* Substrate
30*u* Uppermost Adhesive Tape Strip
30*p* Lowermost Adhesive Tape Strip
30*x* Longitudinal Axis of Adhesive Tape Strips
30*y* Lateral Axis of Adhesive Tape Strips
31 First Longitudinal End of Adhesive Tape Strip
32 Second Longitudinal End of Adhesive Tape Strip

33 First Lateral Side of Adhesive Tape Strip
34 Second Lateral Side of Adhesive Tape Strip
35 First Major Surface of Adhesive Tape Strip
36 Second Major Surface of Adhesive Tape Strip
40 Adhesive Coating
50 Low Adhesion Backsize Coating
51 Area of Low Adhesion Backsize Pattern Coated for Higher Adhesion
52 Area of Low Adhesion Backsize Pattern Coated for Lower Adhesion
60 Leader Strip
**60*x*** Longitudinal Axis of Leader Strip
**60*y*** Lateral Axis of Leader Strip
61 First Longitudinal End of Leader Strip
62 Second Longitudinal End of Leader Strip
63 First Lateral Side of Leader Strip
64 Second Lateral Side of Leader Strip
65 First Major Surface of Leader Strip
66 Second Major Surface of Leader Strip
67 Detackifying Agent
68 Tacky Area of First Major Surface of Leader Strip
69 Nontacky Area of First Major Surface of Leader Strip (Pull tab portion)
**69*y*** Lateral Axis of Pull tab portion
70 Dispenser
71 Base
**72*f*** Front Wall of Dispenser
**72*b*** Back Wall of Dispenser
72 Side Walls of Dispenser
73 Top of Dispenser
**73*f*** First Side of Dispenser Top
**73*b*** Second Side of Dispenser Top
74 Opening in Top of Dispenser
**75*f*** First Abutment Surface
**75*b*** Second Abutment Surface
76 Retention Chamber
80 Cover
120 Adhesive Tape Flag Pad
**120*x*** Longitudinal Axis of Adhesive Tape Flag Pad
**120*y*** Lateral Axis of Adhesive Tape Flag Pad
121 First Longitudinal Edge of Adhesive Tape Flag Pad
122 Second Longitudinal Edge of Adhesive Tape Flag Pad
130 Individual Adhesive Tape Flags
**130*u*** Uppermost Adhesive Tape Flag
**130*p*** Lowermost Adhesive Tape Flag
**130*x*** Longitudinal Axis of Adhesive Tape Flags
**130*y*** Lateral Axis of Adhesive Tape Flags
131 First Longitudinal End of Adhesive Tape Flags
132 Second Longitudinal End of Adhesive Tape Flags
133 First Lateral Side of Adhesive Tape Flags
134 Second Lateral Side of Adhesive Tape Flags
135 First Major Surface of Adhesive Tape Flags
136 Second Major Surface of Adhesive Tape Flags
138 Tacky Area of First Major Surface of Adhesive Tape Flags
139 Nontacky Area of First Major Surface of Adhesive Tape Flags
140 Adhesive Coating
200 Master Pad
**200*m*** Machine Direction
**200*t*** Transverse Direction
203 First Side of Master Pad
204 Second Side of Master Pad
**205*r*** First Uncovered Side Margin
**205*s*** Second Uncovered Side Margin
206 Uncovered Intermediate Gaps Between Lengths of Tabbing Material
210 Length of Tabbing Material
213 First Side of Tabbing Material
214 Second Side of Tabbing Material
218 Nontacky Side Margins on Tabbing Material
219 Tacky Central Area on Tabbing Material
**219*x*** Longitudinal Axis of Tacky Central Area on Tabbing Material
250 Machine Direction Cut Line
320 Adhesive Note Pad
**320*x*** Longitudinal Axis of Adhesive Note Pad
**320*y*** Lateral Axis of Adhesive Note Pad
321 First Longitudinal Edge of Adhesive Note Pad
322 Second Longitudinal Edge of Adhesive Note Pad
330 Individual Adhesive Notes
**330*u*** Uppermost Adhesive Note
**330*p*** Lowermost Adhesive Note
**330*x*** Longitudinal Axis of Adhesive Notes
**330*y*** Lateral Axis of Adhesive Notes
331 First Longitudinal End of Adhesive Notes
332 Second Longitudinal End of Adhesive Notes
333 First Lateral Side of Adhesive Notes
334 Second Lateral Side of Adhesive Notes
335 First Major Surface of Adhesive Notes
336 Second Major Surface of Adhesive Notes
338 Tacky Area of First Major Surface of Adhesive Notes
339 Nontacky Area of First Major Surface of Adhesive Notes
340 Adhesive Coating
400 Stationery Pad
405 Individual Sheets
406 Binder Material
410 Header
**410*d*** Header Depth
**410*h*** Header Length
**410*w*** Header Width
**410*f*** Front Surface of Header
**410*b*** Back Surface of Header
419 Pocket
**419*d*** Pocket Depth
**419*h*** Pocket Length
**419*w*** Pocket Width
420 Backer Label

Definitions

The term "adhesive note" is a widely used term of art which is utilized herein in accordance with its standard industry meaning. Broadly, an adhesive note is a printable substrate, usually paper, with an upper portion of a first major surface coated with an adhesive, usually a repositionable adhesive. Adhesive notes are usually square or rectangular in shape and about 3 to 10 cm wide and about 3 to 20 cm long, although other sizes and shapes are certainly possible.

The term "major surface" refers to the top and bottom surfaces of a sheet, such as the top surface of the paper sheet upon which these words are printed.

As utilized herein, including the claims, the term "nontacky" means lack of adhesive tack at room temperate and pressure.

The term "repositionable adhesive" is a term of art which is utilized herein in accordance with its standard industry meaning. Broadly, a repositionable adhesive is an adhesive which permits typical tape strip and tape flag substrates, such as paper and polymeric films, to be repeatedly attached to and removed from various surfaces, such as paper, without significant loss in adhesive strength, without leaving adhesive residue upon the surface, and without destruction of the substrate.

The term "header padded stationery", as utilized herein and including the claims, refers to padded stacks of printed and/or printable sheets having one end permanently adhered together so as to form a header. The individual sheets in a pad of header padded stationery are typically perforated proximate the header for facilitating the removal of individual sheets from the pad. Typical header padded stationery include a number of standard office supply items such as artist pads, easel pads, notebook pads, legal pads, calendars, personal organizers, day planners, etc.

The term "stacking profile", as utilized herein and including the claims, refers to those elements in the profile of an item which contact adjacent items when the items are stacked. For example, legal pads are usually stacked front to back for purposes of shipping, storage and display. Hence, changes to the configuration of the front and back surfaces of a legal pad which would cause the points of contact between the stacked pads to change, such as the attachment of a writing utensil to the front of the header on each pad, would impact the stacking profile. Alternatively, attachment of a writing utensil to the top of the header on each pad would not change the points of contact between such front to back stacked pads, and therefore would not impact the stacking profile.

The term "tape flag" is a widely used term of art which is utilized herein in accordance with its standard industry meaning. Broadly, a tape flag is a flexible substrate with a first end of a first major surface coated with an adhesive, usually a repositionable adhesive, and a nontacky second end. Tape flags are usually rectangular in shape and about 1 to 6 cm wide and about 3 to 10 cm long, although other sizes and shapes are certainly possible. The nontacky end of the substrate is typically color coded or printed with indicia. A variety of means are employed to render the second end of the first major surface nontacky including (i) limiting application of the adhesive coating to the first end of the first major surface, and (ii) allowing the adhesive coating to be applied to the entire surface area of the first major surface and then applying a nontacky material, coating or liner over the adhesive at the second end.

The term "tape strip" is a widely used term of art which is utilized herein in accordance with its standard industry meaning. Broadly, a tape strip is a flexible substrate with a first major surface coated with an adhesive. Tape strips are usually rectangular in shape and about 1 to 10 cm wide and about 3 to 20 cm long, most frequently about 1 to 5 cm wide and about 3 to 20 cm long, although other sizes and shapes are certainly possible.

Construction

Figure 4:
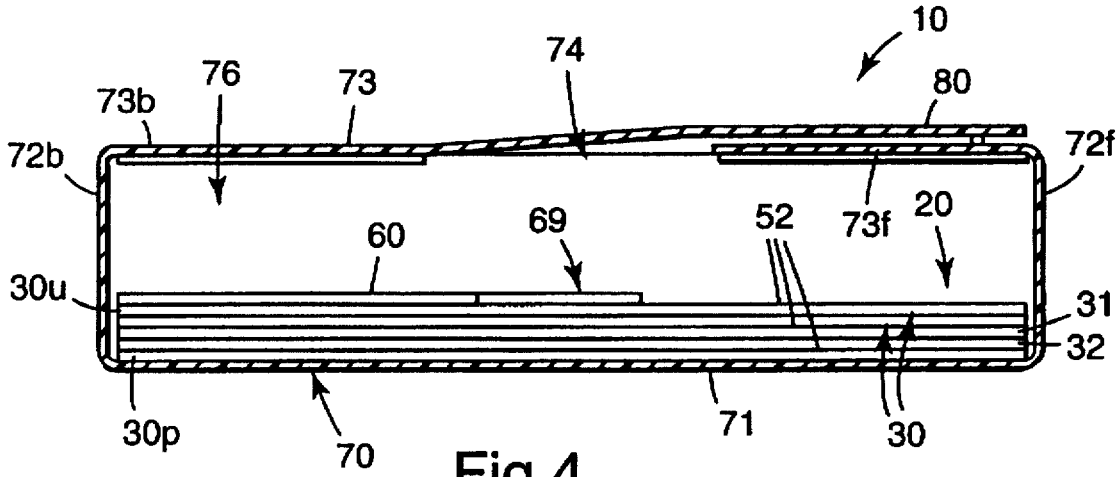
FIGS. 4 through 8 are enlarged sectional side view of the dispenser package shown in FIG. 1 illustrating sequential dispensing of adhesive tape strips from the adhesive tape strip pad within the dispenser.
Figure 12:
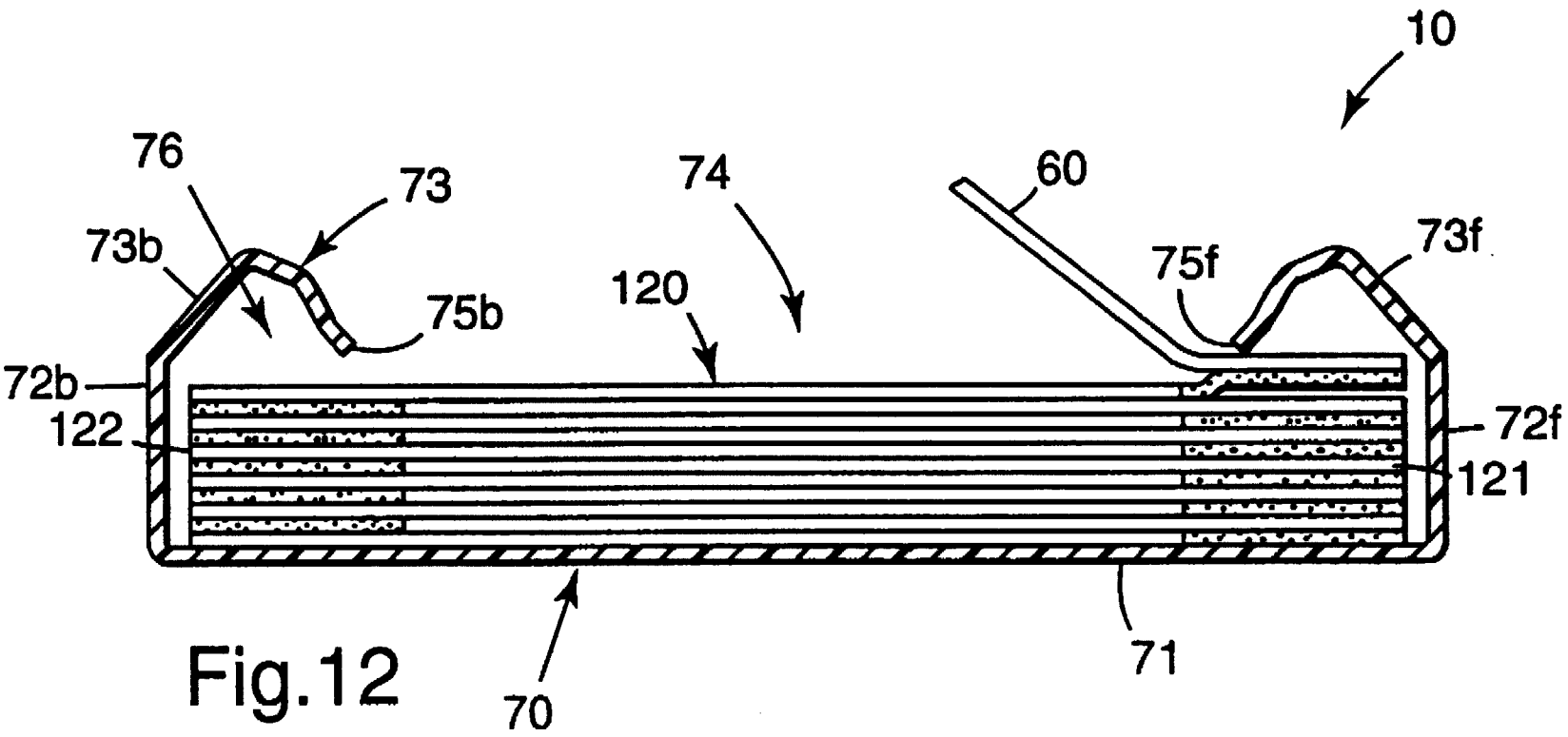
FIG. 12 is a side view of a second embodiment of a dispenser package depicting adhesive tape flags within an open dispenser prior to pulling of the leader strip from the pad of adhesive tape flags.
Figure 13:
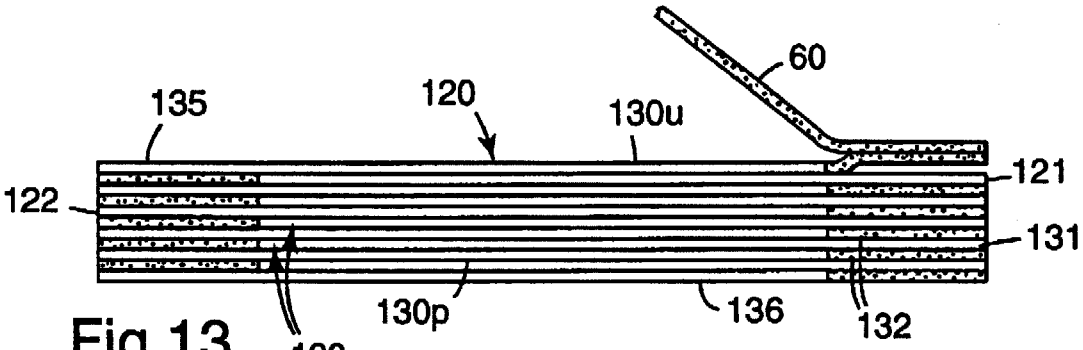
FIG. 13 is a side view of the adhesive tape flag pad shown in FIG. 12.
Figure 14:
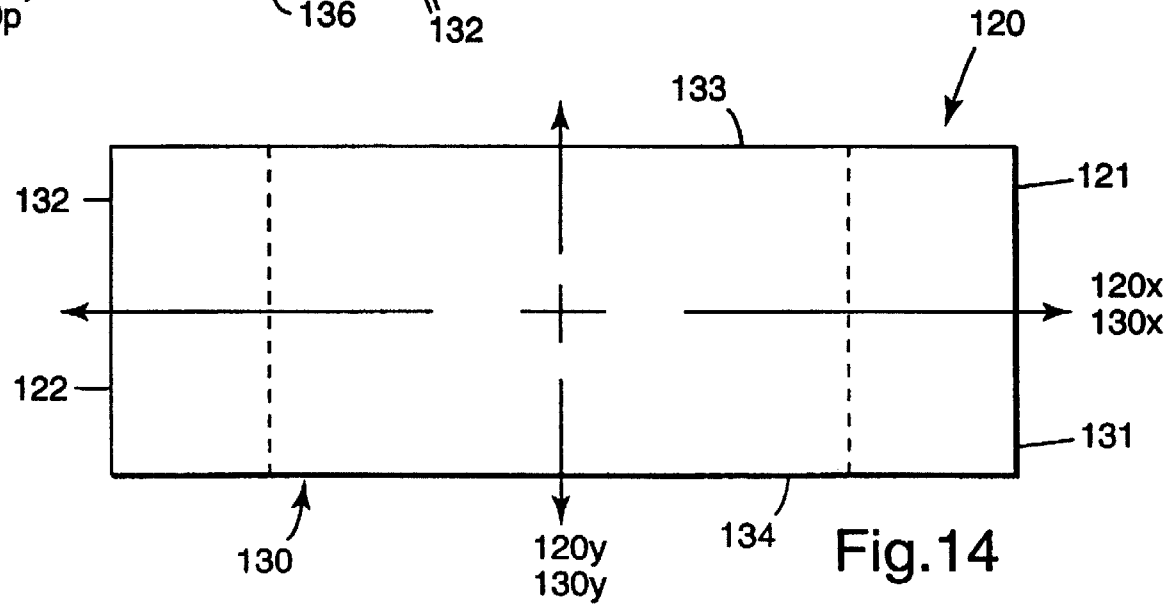
FIG. 14 is a top view of the adhesive tape flag pad shown in FIG. 13.
Figure 15:
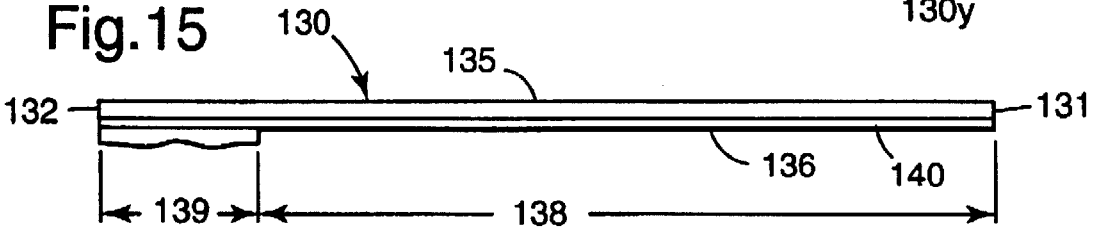
FIG. 15 is an enlarged and exploded side view of one of the adhesive tape flags shown in FIG. 13.

A dispenser package 10 including an adhesive sheet pad 20, 120, 320 retained within a dispensing enclosure 70 (as illustrated, for example, in FIG. 4, 12, and 16) are recessed within the header 410 of header padded stationery 400 of FIG. 1. The adhesive sheet pad 20, 120, 320 may be a pad of adhesive tape strips 30, adhesive tape flags 130 or adhesive notes 330.

In a preferred embodiment, unique leader strip 60 is provided on adhesive sheet pad 20, 120, 320 for initiating dispensing. The leader strip 60 is simple and inexpensive to manufacture and install on the pads 20, 120, 320, useful with a variety of different types of dispensers, reliable, and easy for consumers to use.

Header Padded Stationery Pad

Figure 2:
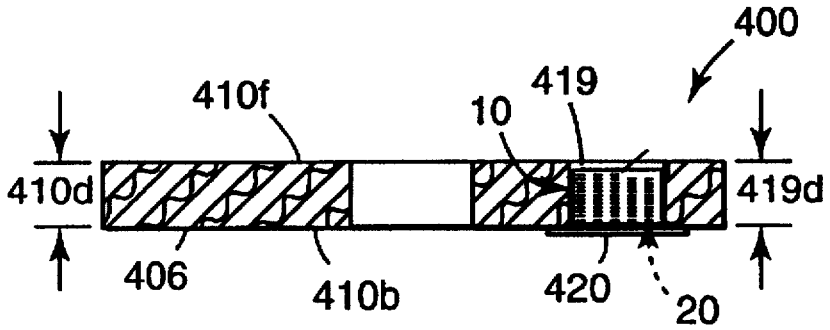
FIG. 2 is a cross-sectional rear view of the invention depicted in FIG. 1 taken along line 2—2.

As shown best in FIGS. 1 and 2, the header padded stationery 400 includes a plurality of superimposed sheets 405 which are permanently attached at the top (unnumbered) so as to form a header 410. The width 410*w* of the header 410 generally matches the width (unnumbered) of the individual sheets 405. The depth 410*d* of the header 410 is defined by the thickness of the individual sheets 405 and the thickness (unnumbered) of any backer sheet (not shown) and/or binder material 406 added to the stationery pad 400. The length 410*h* of the header 410 is generally a matter of design choice, so long as a sufficient length of the individual sheets 405 are contained within the header 410 to prevent the accidental release of sheets 405 from the stationery pad 400.

The individual sheets 405 are perforated (not shown) proximate the lower edge 411 of the header 410 to facilitate the removal of individual sheets 405 from the stationery pad.

Adhesive Tape Strip Pad

Individual Tape Strips

The preferred adhesive tape strip pad 20 comprises a leader strip 60 attached to a pad 20 of adhesive tape strips 30 as shown in FIGS. 4 through 11.

The adhesive tape strip pad 20 is comprised of a plurality of superimposed individual tape strips 30. The tape strips 30 are constructed from a flexible substrate 30*s*, such as paper, polyethylene, polypropylene, polyethylene terephthalate, etc. The individual tape strips 30 define a longitudinal axis 30*x* and a lateral axis 30*y* and have a first longitudinal end 31, a second longitudinal end 32, a first lateral side 33, a second lateral side 34, a first major surface 35, and a second major surface 36. The first major surface 35 of each tape strip 30 is coated with a low adhesion backsize 50 to facilitate separation of the superimposed individual strips 30. The second major surface 36 of each tape strip 30 is coated with an adhesive 40, such as a repositionable adhesive or permanent pressure sensitive adhesive.

Suitable adhesives 40 may be any of the well known repositionable adhesives disclosed in the literature, including any of the various microsphere-based repositionable adhesives, such as the revolutionary microsphere adhesive utilized to produce the famous Post-It® brand notes manufactured by Minnesota Mining and Manufacturing Company. A most preferred repositionable adhesive 40, effective for providing aggressive adhesion without sacrificing the other characteristics required of a repositionable adhesive composition comprises a blend of one or more microspheres and an adhesive binder comprising at least one acrylamide-based moiety. Preferably, the microspheres are polymeric, inherently tacky, elastomeric microspheres; and the binder is a pressure sensitive adhesive polymer having at least one acrylamide moiety, with the acrylamide moiety optionally copolymerized with one or more free radically polymerizable monomers, such as an acrylate or methacrylate. A detailed discussion of these types of adhesives is provided in WO 94/19420, published on 09 Jan. 1994. Other useful permanent pressure sensitive adhesives include those described in WO 95/35215, published 28 Dec. 1995.

Tape Strip Pad

The pad 20 of adhesive tape strips 30 defines a longitudinal axis 20*x* and a lateral axis 20*y*, and has a first longitudinal edge 21 and a second longitudinal edge 22. The pad 20 has an uppermost tape strip 30*u* and a lowermost tape strip 30*p*.

The pad 20 is formed from any desired number of individual adhesive tape strips 30, preferably between about 10 and 120 tape strips 30, by adhering the second major surface 36 of each individual tape strip 30 to the first major surface 35 of an immediately underlying tape strip 30. The first major surface 35 of the tape strips 30 are pattern coated with a low adhesion backsize 50, wherein a first pattern coating is provided over a first area 51 and a second pattern coating is provided over a second area 52 of the adhesive tape strips 30. The first pattern coating permits a higher adhesion strength than the second pattern coating (i.e., the pattern of the first pattern coating covers less surface area than the pattern of the second pattern coating). The individual adhesive tape strips 30 are then stacked in a Z pattern with successive strips 30 in the pad 20 positioned with the high adhesion pattern coated area 51 of each strip 30 alternating between the first 21 and second 22 longitudinal edges of the pad 20. The difference in adhesive strength between the high adhesion pattern coated area 51 and the low adhesion pattern coated area 52 is selected so that the lower adhesive strength portion 52 of each strip 30 will delaminate from the immediately underlying strip 30 when an immediately overlying strip 30 is peeled from the pad 20.

The change in adhesive strength can also be achieved by several other mechanisms, including specifically, but not exclusively, (i) coating only a portion of the first major surface 35 of each tape strip 30 with low adhesion backsize 50, (ii) coating only a portion of the second major surface 36 of each tape strip 30 with adhesive 40, and (ii) pattern coating the adhesive 40 onto the second major surface 36 of each tape strip 30 in a fashion similar to the pattern coating of the low adhesion backsize 50 described above.

Adhesive Tape Flag Pad

Individual Tape Flags

The preferred adhesive tape flag pad 120 comprises a leader strip 60 attached to a pad 120 of adhesive tape flags 130 as shown in FIGS. 12 through 15.

The adhesive tape flag pad 120 is comprised of a plurality of superimposed individual tape flags 130. The tape flags 130 are constructed from a flexible substrate 130*s*, such as paper, polyethylene, polypropylene, polyethylene terephthalate, etc. The individual tape flags 130 define a longitudinal axis 130*x* and a lateral axis 130*y* and have a first longitudinal end 131, a second longitudinal end 132, a first lateral side 133, a second lateral side 134, a first major surface 135, and a second major surface 136.

The second major surface 136 of each tape flag 130 is coated with an adhesive 140, usually a repositionable adhesive. A first longitudinal end portion 138 of the second major surface 136 of each tape flag 130 is rendered tacky by the adhesive coating 140, while a second longitudinal end portion 139 of the second major surface 136 of each tape flag 130 is rendered nontacky by any suitable means such as application of a liner (not shown), application of detackifying particles (not shown), or avoiding the initial application of adhesive 140 to the area, etc. This effectively divides the tape flag 130 into a tacky longitudinal end portion 138 and a nontacky longitudinal end portion 139.

Tape Flag Pad

The pad 120 of adhesive tape flags 130 defines a longitudinal axis 120*x* and a lateral axis 120*y*, and has a first longitudinal edge 121 and a second longitudinal edge 122. The pad 120 has an uppermost tape flag 130*u* and a lowermost tape flag 130*p*.

The pad 120 is formed from any desired number of individual adhesive tape flags 130, preferably between about 10 and 120 tape flags 130, by adhering the second major surface 136 of each individual tape flag 130 to the first major surface 135 of an immediately underlying tape flag 130. The tacky first longitudinal end portion 68 of the leader strip 60 is adhesively bonded to the first major surface 135 of the uppermost tape flag 130*u* while the nontacky second longitudinal end portion 69 of the leader strip 60 defines a pull tab portion 69 which can be lifted from the pad 120 and pulled to initiate dispensing of the individual adhesive tape flags 130 from the pad 120.

The individual adhesive tape flags 130 are then stacked in a Z pattern with successive flags 130 in the pad 120 positioned with the tacky area 138 of each flag 130 alternating between the first 121 and second 122 longitudinal edges of the pad 120. Such an alternating pattern causes the nontacky area 139 of each flag 130 to be pulled from the surface of the pad 120 when an immediately overlying flag 130 is peeled from the pad 120.

Adhesives Notes

Idividual Notes

Figure 16:
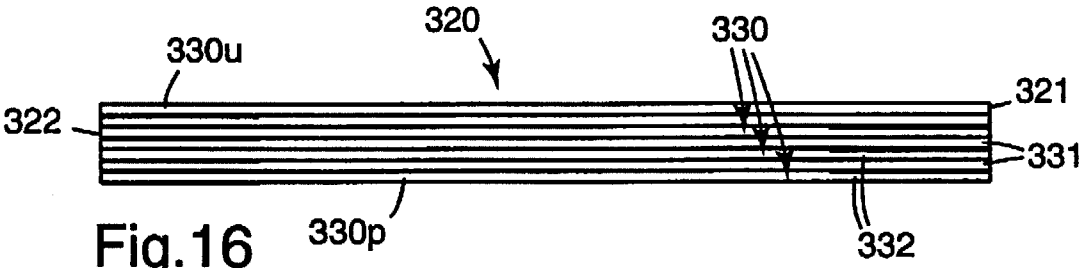
FIG. 16 is a side view of an adhesive note pad.
Figure 17:
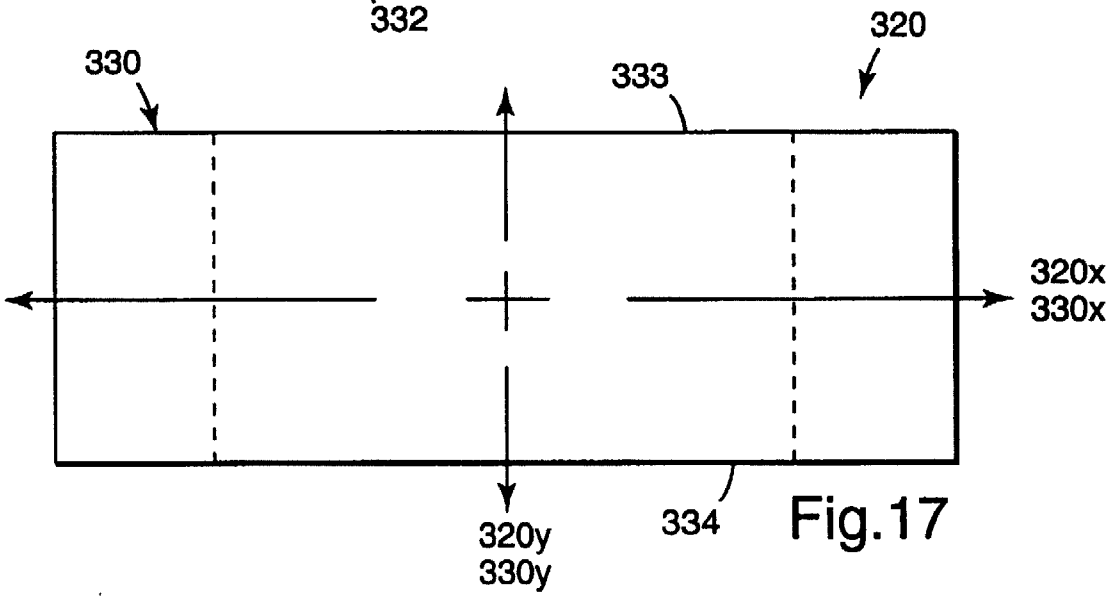
FIG. 17 is a top view of the adhesive note pad shown in FIG. 16.
Figure 18:
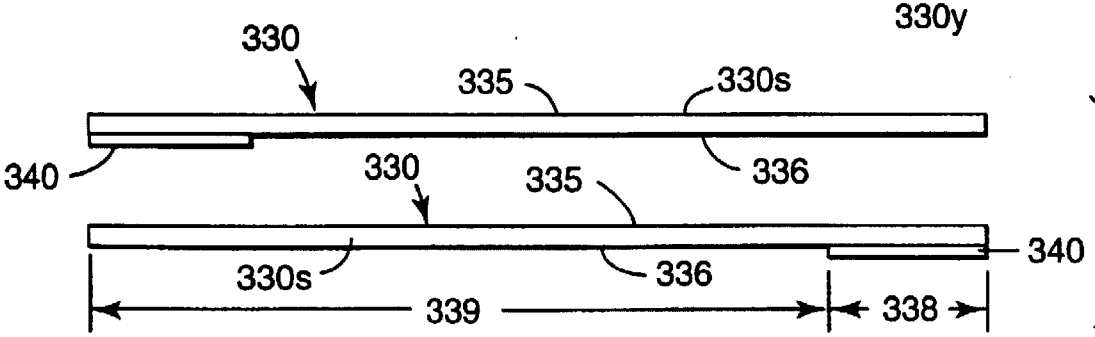
FIG. 18 is an enlarged and exploded side view of two of the adhesive notes shown in FIG. 16.

The preferred adhesive note pad 320 comprises a pad 320 of adhesive notes 330 overlapped in a Z pattern as shown in FIGS. 16 through 18.

The adhesive note pad 320 is comprised of a plurality of superimposed individual notes 330. The notes 330 are constructed from a flexible and printable substrate 330*s*, such as paper. The individual notes 330 define a longitudinal axis 330*x* and a lateral axis 330*y* and have a first longitudinal end 331, a second longitudinal end 332, a first lateral side 333, a second lateral side 334, a first major surface 335, and a second major surface 336.

The first major surface 335 of the individual notes 330 are provided with a low adhesion backsize (not shown) to facilitate ease of removal.

A first longitudinal end portion 338 of the second major surface 336 of each note 330 is coated with an adhesive 340, usually a repositionable adhesive. The remainder of the second major surface 336 of each note 330 is not coated with adhesive and remains nontacky. This effectively divides the note 330 into a tacky longitudinal end portion 338 and a nontacky longitudinal end portion 339.

Notes

The pad 320 of adhesive notes 330 defines a longitudinal axis 320*x* and a lateral axis 320*y*, and has a first longitudinal edge 321 and a second longitudinal edge 322. The pad 320 has an uppermost note 330*u* and a lowermost note 330*p*.

The pad 320 is formed from any desired number of individual adhesive notes 330, preferably between about 10 and 120 notes 330, by adhering the second major surface 336 of each individual note 330 to the first major surface 335 of an immediately underlying note 330. The nontacky longitudinal end portion 339 of the uppermost note 330*u* can be lifted from the pad 320 and pulled to initiate dispensing of the individual notes 330 from the pad 320.

The individual adhesive notes 330 are then stacked in a Z pattern with successive notes 330 in the pad 320 positioned with the tacky area 338 of each note 330 alternating between the first 321 and second 322 longitudinal edges of the pad 320. Such an alternating pattern causes the nontacky area 339 of each note 330 to be pulled from the surface of the pad 320 when an immediately overlying note 330 is peeled from the pad 320.

For purposes of facilitating further discussion of the invention, the balance of the discussion will be based upon the adhesive tape strip embodiment only. This is not intended and should not be construed to limit the scope of the invention in any way.

Leader Strip

The preferred embodiments of the adhesive tape strip pads 20, adhesive tape flag pads 120, and adhesive note pads 320 include a leader strip 60 for purposes of initiating dispensing as shown in FIGS. 19 through 20.

A leader strip 60 having substantially the same width and about ½ to ¾ the length of the adhesive tape strip pad 20 is aligned with and superimposed over the first major surface 35 of the uppermost tape strip 30*u* proximate the first longitudinal edge 21 of the pad 20.

The leader strip 60 defines a longitudinal axis 60*x* and a lateral axis 60*y* and has a first longitudinal end 61, a second longitudinal end 62, a first lateral side 63, a second lateral side 64, a first major surface 65, and a second major surface 66. The second major surface 66 of the leader strip 60 is coated with an adhesive 40, such as a repositionable adhesive or permanent pressure sensitive adhesive. The adhesive 40 at a first longitudinal end portion 69 of the leader strip 60 is detackified by overcoating the adhesive 40 with a suitable detackifying agent 67, such as varnish or talc, so as to divide the leader strip 60 into a tacky first longitudinal end portion 68 and a nontacky second longitudinal end portion 69. The tacky first longitudinal end portion 68 of the leader strip 60 is adhesively bonded to the first major surface 35 of the uppermost tape strip 30*u* while the nontacky second longitudinal end portion 69 defines a pull tab portion 69 which can be lifted from the pad 20 and pulled to initiate dispensing of the individual adhesive tape strips 30 from the pad 20.

The first longitudinal end 61 of the leader strip 60 is aligned with the first longitudinal edge 21 of the pad 21 so as to position the tacky first longitudinal end portion 68 of the leader strip 60 proximate the first longitudinal edge of the pad. The nontacky second longitudinal end portion 69 of the leader strip 60 is positioned intermediate the first 21 and second 22 longitudinal edges of the pad 20 so as to form a nontacky centrally positioned pull tab portion 69.

The pull tab portion 69 is preferably positioned on the pad 20 so that the free longitudinal end 62 of the pull tab portion 69 is longitudinally spaced less than about one fifth of the longitudinal length of the pad 20 away from the lateral axis 20*y* of the pad More specifically, the pull tab portion 69 is preferably positioned on the pad 20 such that a plane defined by the lateral axis 60*y* of the pull tab portion and the lateral axis 20*y* of the pad 20 extends substantially perpendicular to a plane defined by the uppermost tape strip 30*u*.

Alternatively, the pull tab portion 69 is preferably positioned on the pad 20 such that a plane defined by the free longitudinal end 62 of the pull tab portion 60 and the lateral axis 20*y* of the pad 20 extends substantially perpendicular to a plane defined by the uppermost tape strip 30*u*.

A third alterative method of determining the desired position of the pull tab portion 69 on the pad 20 is to longitudinally position the free longitudinal end 62 of the pull tab portion 69 between a first longitudinal boundary defined by the longitudinal position of the lateral axis 20*y* of the pad 20, and a second longitudinal boundary extending a distance of about three tenths of the longitudinal length of the pad 20 from the lateral axis 20*y* of the pad 20 towards the first longitudinal edge 21 of the pad 20.

A fourth alternative method of measuring the desired position of the pull tab portion 69 on the pad 20, 120, 320 positions the free longitudinal end 61 of the pull tab portion 69 proximate the lateral center of the opening 74 in the dispenser 70.

Dispenser

The adhesive tape strip pads 20, adhesive tape flag pads 120 and adhesive note pads 320 can be conveniently dispensed from any of the commonly used dispensers for such pads. Briefly, such dispensers 70 have a base 71, a front wall 72*f*, a back wall 72*b*, side walls 72*r* and 72*s*, and a top 73 which is split between a first side 73*r* and a second side 73*s* by a centrally positioned opening 74 which extends substantially the entire width of the retention chamber 76 defined by the dispenser 70. The length of the opening 74 is large enough to permit the passage of a tape strip 30 through the opening 74 yet small enough to prevent the full length of a tape strip 30 from falling back into the retention chamber 76 once a portion of the tape strip 30 has been pulled through the opening 74. Removal of a tape strip 30 from the dispenser 70 causes an end portion (unnumbered) of the immediately underlying tape strip 30 to be pulled through the opening 74 and rest upon one of the abutment surfaces 74*r* and 74*s* where it is presented for future removal from the dispenser 70.

A cover 80 may optionally be employed to seal the opening 74 through the top 73 of the dispenser 70.

The center tabbed pads 20, 120 and 320 of this invention are particularly useful in connection with open throat dispensers in which the opening 74 in the top 73 of the dispenser 70 is of sufficient size, generally about one third to three fourths the length of the pad retained within the dispenser 70, to permit a user to reach through the opening 74 and into the retention chamber 76 to access the pull tab portion 69 on the leader strip 60. Alternatively, although less preferred, the pull tab portion 69 on the leader strip 60 may be attached to the cover 80 so that the leader strip 60 is pulled from the dispenser 70, along with a portion of the uppermost adhesive tape strip 30*u*, when the cover 80 is removed from the dispenser 70. Use of such an alternative embodiment is necessary when the opening 74 in the top 73 of the dispenser 70 is less than about 2 cm, since the size of the opening prevents a user from reaching into the retention chamber 76 to access the pull tab portion 69.

The dispenser 70 may be constructed as a refillable dispenser which is equipped with a mechanism operable for allowing accesses to the retention chamber 76 for purposes of inserting a new pad 20 into the chamber 76. The dispenser 70 may also be attached to the header 410 so as to be replaceable.

The dispenser 70 may be constructed as a shuttling dispenser or a nonshuttling dispenser. Briefly, a shuttling dispenser 70 has a retention chamber 76 with a length which permits the pad 20 within the chamber 76 to shuttle back and forth within the chamber 76 as individual tape strips 30 are pulled from the pad 20. In contrast, a nonshuttling dispenser 70 has a retention chamber 76 which is sized to accommodate a pad 20 with substantially no space for back and forth shuttling of the pad 20 within the chamber 76 as individual tape strips 30 are pulled from the pad 20. Due to the necessity of a larger opening 74 in nonshuttling dispensers 70, the pad 20 should be adhered to the base 71 of the dispenser 70 in order to prevent the pad 20 from being pulled through the opening 74 when individual strips 30 are pulled from the pad 20.

Combination Stationery Pad And Adhesive Sheet Pad

As shown in FIGS. 1 and 2, a dispenser package 10 containing an adhesive sheet pad 20, 120, 320 is retained within a pocket 419 cut into the header 410 of a header padded stationery pad 400. The depth 419*d* of the pocket 419 permits an adhesive sheet pad 20, 120, 320 containing the desired number of strips, flags or notes to be retained within the pocket 419 without extending beyond the front surface 410*f* of the header 410 or changing the profile of the header 410. Of course, the length 410*h* and width 410*w* of the header 410 must be sized sufficiently larger than the desired length 419*h* and width 419*w* of the pocket 419 that the structural integrity of the stationery pad is maintained. For example, a header which is 20 cm wide by 4½ cm long cannot reasonably be expected to accommodate a 6 cm by 4 cm adhesive sheet pad 20, 120, 320 since the pocket 419 would leave less than ¼ cm of the header 410 along the top and bottom of the pocket 419 and risk structural failure of the header 410 in those areas.

In a preferred embodiment, the adhesive sheet pad 20, 120, 320 is retained within a dispenser 70 and both the adhesive sheet pad 20, 120, 320 and the dispenser 70 are inserted into the pocket 419 cut into the header 410. In a second preferred embodiment, the pocket 419 is configured to function as the dispenser. An oversized adhesive coveting label (not shown) is then adhered to the header 410 with a nontacky area of the label positioned over the pocket 419 in order to function as the top of the dispenser formed from the header 419 and retain the adhesive sheet pad 20, 120, 320 within the pocket 419. A central portion (not shown) of the covering label (not shown) is perforated to permit a portion of the label to be removed and thereby form an opening through which the adhesive sheets 20, 120, 320 may be dispensed.

The pocket 419 may be cut partially into or completely through the header 410. When the pocket 419 is cut completely through the header 410, an adhesively coated backer label 420 may be applied to the back surface **410*b* of the header 410 over the pocket 419 in order to prevent an adhesive sheet pad 20, 120, 320 and dispenser 70 positioned within the pocket 419 from failing out of the pocket 419 through the back 410*b* of the header 410**.

The pocket 419 and dispenser 70 may optionally be configured together to permit the dispenser 70 to be removed from the pocket 419 and replaced with a new dispenser 70 when the supply of adhesive sheets 30, 130, 330 within the dispenser 70 have been depleted.

It is also possible to incorporate more than one adhesive sheet pad 20, 120, 320 into a header 410 provided the header 410 is large enough to accommodate multiple pads 20, 120, 320. Hence, it may be possible to incorporate an adhesive tape strip pad 20 and an adhesive note pad 320 into two different pockets 419 in the header 410 of an easel pad 400 or artist pad (not shown) since such stationery pads are generally configured with large headers 410.

Method of Making

Adhesive Sheet Pads

The center tabbed adhesive tape strip pads 20 of this invention, as well as center tabbed adhesive tape flag pads 120, may be quickly, easily and reliably manufactured from large master pads 200 of the type commonly utilized to produce standard adhesive tape strip pads as shown in FIG. 21.

The center tabbed aspect of the invention may be conveniently added to a master pad 200 using lengths of tabbing material 210 which are configured with (i) first 213 and second 214 sides; (ii) a first major surface 215 having nontacky first and second side margins 218 and an adhesively coated tacky central area 219 between the side margins, and (iii) a nontacky second major surface 216.

The procedure for applying the lengths of tabbing material 210 to a master pad 200 and cutting the resultant tabbed master pad 200 to produce the desired adhesive tape strip pads 20 includes the steps of (1) conveying a master pad 200 of superimposed adhesively coated sheets in a machine direction **200*m*; (2) simultaneously conveying continuous lengths of tabbing material 210 in the machine direction 200*m*, (3) laminating the first major surface 215 of each length of tabbing material 210 to the exposed second major surface (unnumbered) of the uppermost sheet (unnumbered) on the master pad 200, with the lengths of tabbing material 210 laterally positioned on the master pad 200 so as to create side margins 205 and intermediate gaps 206 between neighboring lengths of tabbing material 210 which are not covered with tabbing material 210; (4) cutting the tabbed master pad 200 in the machine direction 200*m* between the nontacky side margins 218 of each length of tabbing material 210 and between the nontacky side margins 218 of each neighboring length of tabbing material 210; and (5) cutting the tabbed master pad in the transverse direction 200*t* so as to produce tape strip pads 20** of the desired width.

The lateral length of the side margins 205 on the master pad 200 which are not covered with tabbing material 210 are preferably about one third to one half the lateral length of the tacky central area 219 on the tabbing material 210 in order to result in proper positioning of the nontacky side margins 218 on the resultant adhesive tape strip pads 20 incorporating such side margins 205. For the same reason, the intermediate gaps 206 between neighboring lengths of tabbing material 210 on the master pad 200 which are not covered with tabbing material 210 are preferably about the same lateral length as the tacky central area 219 on the tabbing material 210.

Stationery Pads With Inserted Adhesive Sheet Pads

An adhesive sheet pad 20, 120, 320 may be quickly and easily incorporated into the header 410 of a stationery pad 400 by simply dye curing a pocket 419 of suitable size and shape into the header 410 at the proper location, and then placing an adhesive sheet pad 30, 130, 330, with or without an accompanying dispenser 70, which contains the desired number and type of adhesive sheets 20, 120, 320, into the pocket 419. In those operations where the pocket 419 has been cut completely through the header 410, the dispenser package 10 may be inserted into the pocket 419 from the back side **410*b* of the header 410, and an oversized adhesive backing label 420 placed over the exposed base 71 of the dispenser 70 and the surrounding area of the header 410 to retain the dispenser package 10 in position within the pocket 419**.

Method of Using Adhesive Sheet Pads

Figure 3:
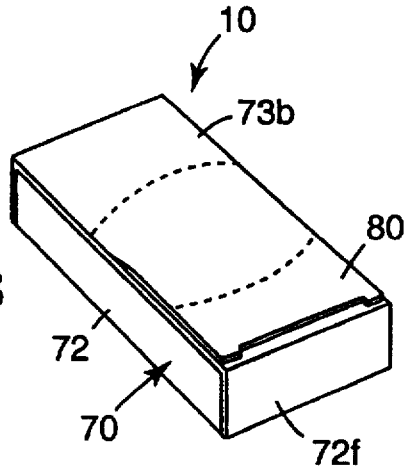
FIG. 3 is an enlarged perspective view of the dispenser package shown in FIG. 1.
Figure 5:
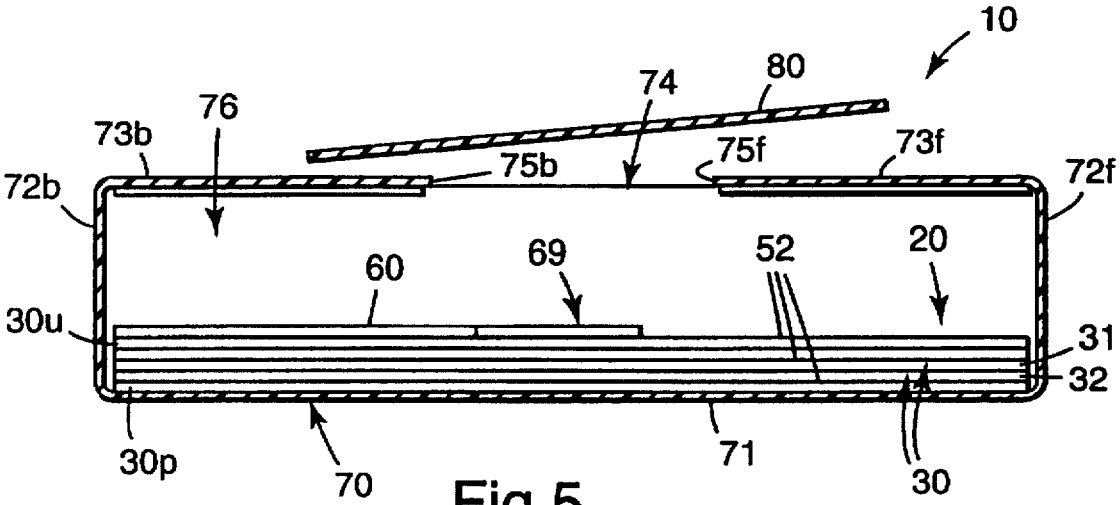
Figure 6:
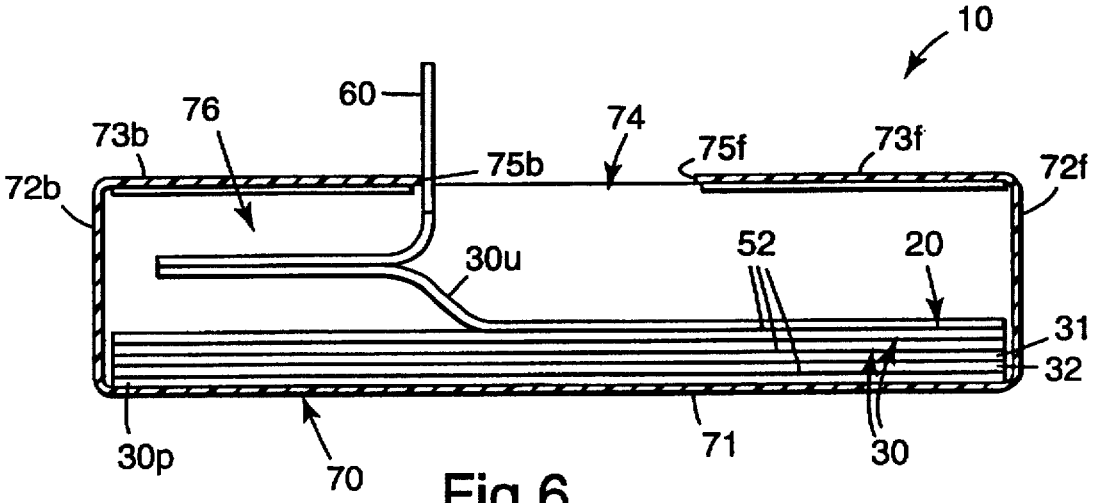
Figure 7:
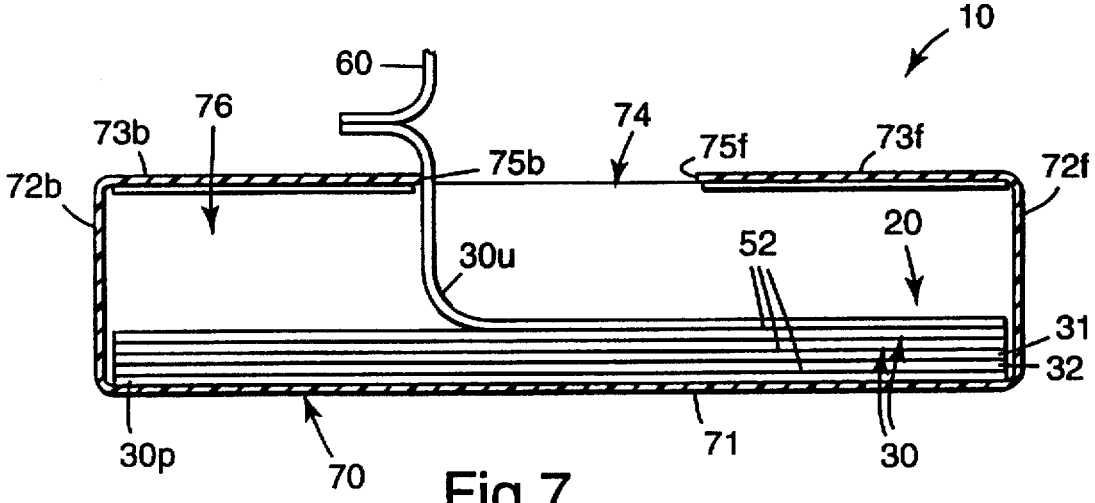
Figure 8:
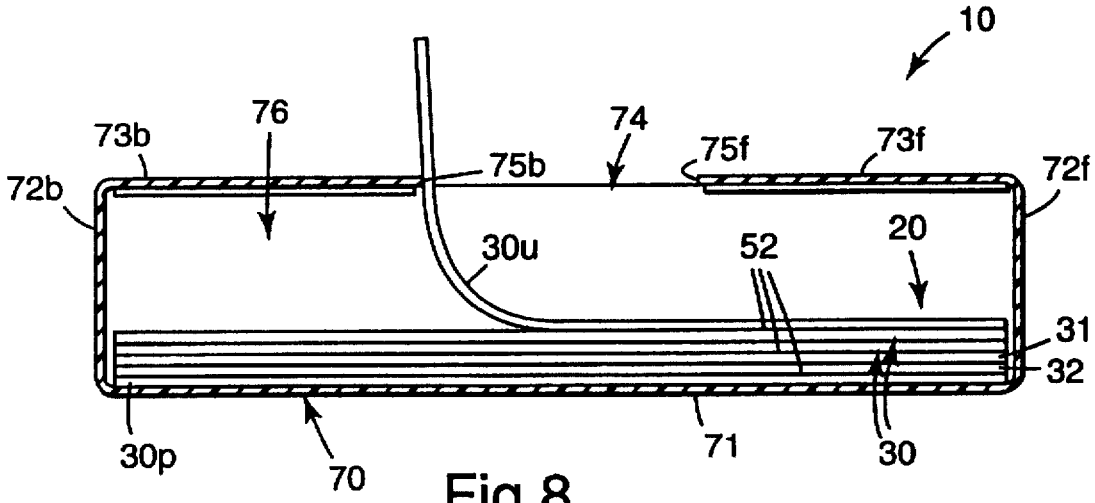
Figure 9:
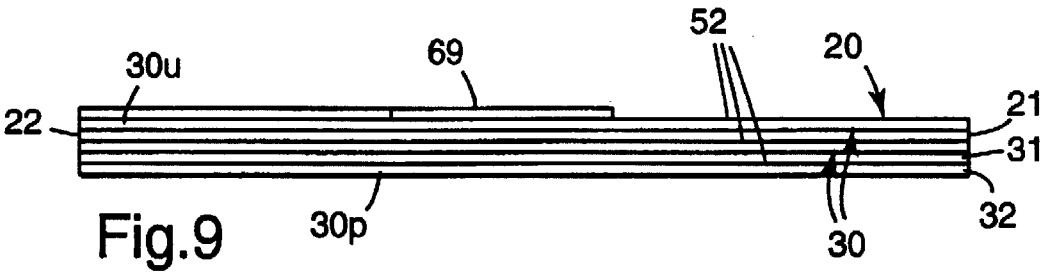
FIG. 9 is a side view of the adhesive tape strip pad shown in FIG. 1.
Figure 10:
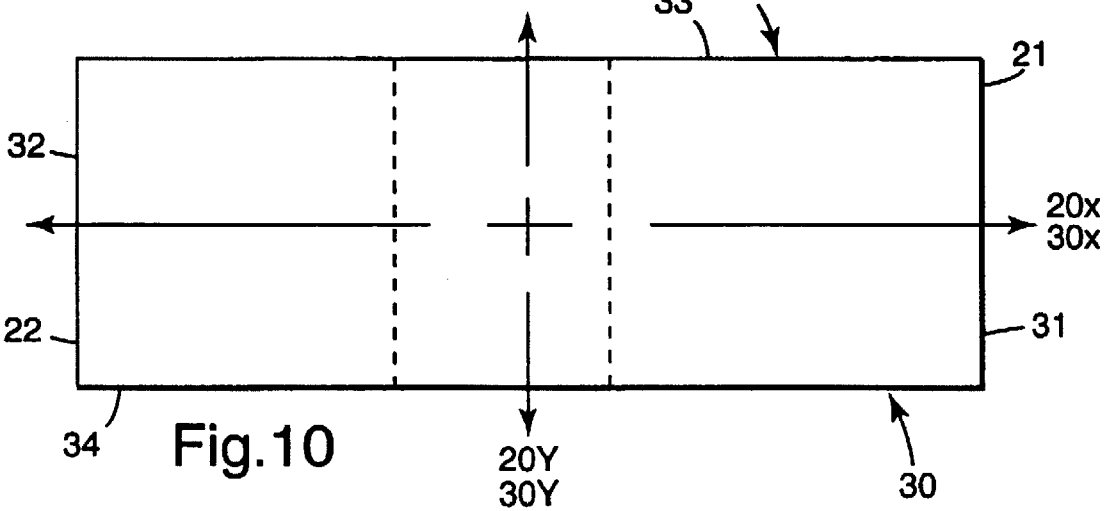
FIG. 10 is a top view of the adhesive tape strip pad shown in FIG. 9.
Figure 11:
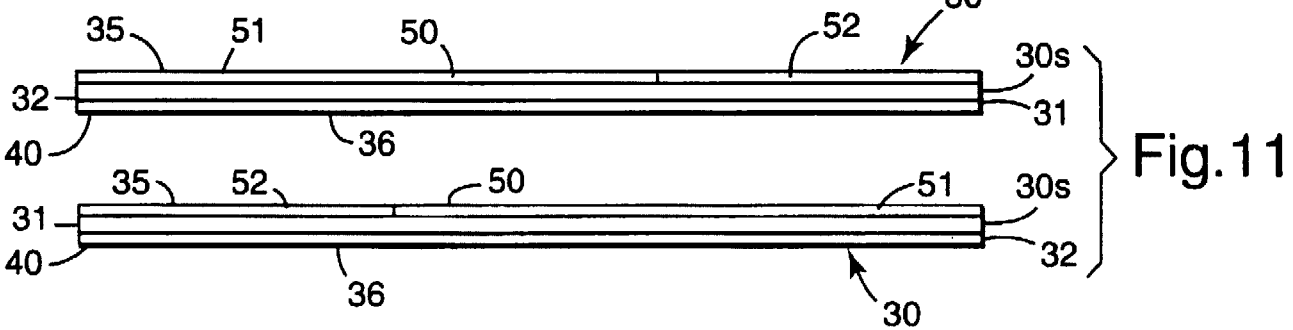
FIG. 11 is an enlarged and exploded side view of two of the adhesive tape strips shown in FIG. 9.

Use of a dispenser package 10 containing the center tabbed adhesive tape strip pad 20 of the invention is illustrated in FIGS. 2 through 6. First, the cover 80 is removed from the dispenser 70 (FIG. 3). The exposed pull tab portion 69 is then gripped with the thumb and pointer finger and pulled through the opening 74 in the top 73 of the dispenser 70 (FIG. 4) until the leader strip 60 is pulled completely out of the retention chamber 76 (FIG. 5). This causes a first longitudinal end 31 of the uppermost adhesive tape strip **30*u* to be pulled through the opening 74 in the top 73 of the dispenser 70 (FIG. 5) and rest against the second abutment surface 75*s* on the dispenser 70 once the leader strip 60 is fully detached (FIG. 6). This method is equally applicable to the embodiment in which the header 419 is configured to function as the dispenser, and an oversized covering label is attached to the header 419** and functions as the top of the dispenser.

I claim:

1. An article comprising:

(a) a stationery pad having a plurality of superimposed stationery sheets attached together at a header and defining a front-to-back stackable profile; and (b) an adhesive sheet pad recessively mounted into the header which is configured and arranged within the header so as to be operable for dispensing individual adhesive sheets without significantly impacting the front-to-back stackable profile of the stationery pad.

2. The article of claim 1 further comprising a dispensing enclosure recessed into the header and surrounding the adhesive sheet pad.

3. The article of claim 2 wherein the dispensing enclosure is a refillable dispenser.

4. The article of claim 2 wherein (i) the dispenser enclosure has a top, (ii) the header has a front surface, and (iii) the dispenser enclosure and adhesive sheet pad are recessed into the header such that the top of the dispenser is substantially flush with the front surface of the header.

5. The article of claim 1 further comprising a covering label attached to the header over the adhesive sheet pad, wherein the covering label has a centrally positioned opening for permitting access to the adhesive sheet pad.

6. The article of claim 1 further comprising a cover over the adhesive sheet pad which is effective for preventing dispensing of adhesive sheets until removed.

7. The article of claim 1 wherein the stationery pad is an easel pad.

8. The article of claim 1 wherein the stationery pad is a notebook pad.

9. The article of claim 1 wherein at least two adhesive sheet pads are mounted to the header.

10. The article of claim 9 wherein the adhesive sheet pads are independently selected from the group consisting of pads of adhesive tape strips, adhesive tape flags, and adhesive notes.

11. An article comprising:

(a) a stationery pad having a plurality of superimposed stationery sheets attached together at a header; and (b) an adhesive sheet pad which is (i) recessively mounted into the header at a recessed depth which is greater than the depth of the adhesive sheet pad, and (ii) operable for dispensing individual adhesive sheets.

12. The article of claim 11 further comprising a dispensing enclosure recessed into the header and surrounding the adhesive sheet pad.

13. The article of claim 12 wherein the dispensing enclosure is a replaceable dispenser.

14. The article of claim 12 further comprising a cover over the dispensing enclosure which is effective for preventing dispensing of adhesive sheets from the dispensing enclosure until removed.

15. The article of claim 11 further comprising a covering label attached to the header over the adhesive sheet pad, wherein the coveting label has a centrally positioned opening for permitting access to the adhesive sheet pad.

16. The article of claim 11 wherein (i) the header has a front surface, (ii) the adhesive sheet pad has a front surface, and (iii) the adhesive sheet pad is recessed into the header such that the front surface of the adhesive sheet pad is substantially flush with the front surface of the header.

* * * * *

UNITED STATES PATENT AND TRADEMARK OFFICE

CERTIFICATE OF CORRECTION

PATENT NO.: 5,697,518

DATED: December 16, 1997

INVENTOR(S): Joseph P. Callahan

It is certified that error appears in the above-identified patent and that said Letters Patent is hereby corrected as shown below:

Column 14, line 19, "coveting" should read --covering--.

Signed and Sealed this

Twenty-fourth Day of August, 1999

*Attest:*

Q. TODD DICKINSON

*Attesting Officer*

*Acting Commissioner of Patents and Trademarks*